United States Patent [19]

Van Der Waal et al.

[11] 4,442,376

[45] Apr. 10, 1984

[54] COLOR DISPLAY TUBE HAVING HEAVY METAL COATING ON COLOR SELECTION ELECTRODE

[75] Inventors: Jan Van Der Waal; Johannes M. A. A. Compen, both of Eindhoven, Netherlands

[73] Assignee: U.S. Philips Corporation, New York, N.Y.

[21] Appl. No.: 282,127

[22] Filed: Jul. 10, 1981

[30] Foreign Application Priority Data

Jul. 16, 1980 [NL] Netherlands ..... 8004075

[51] Int. Cl.[3] ..... H01J 29/07

[52] U.S. Cl. ..... 313/402; 313/408; 313/423; 445/47

[58] Field of Search ..... 313/402, 403, 408, 413, 313/423; 445/47

[56] References Cited

U.S. PATENT DOCUMENTS 2,942,130 6/1960 Sheldon ..... 313/402
3,562,518 2/1971 Javorik et al. ..... 313/408
4,339,687 7/1982 Redington ..... 313/402

FOREIGN PATENT DOCUMENTS 2433498 2/1975 Fed. Rep. of Germany ..... 313/402
54-159863 12/1979 Japan ..... 313/402

*Primary Examiner*—Eugene R. Laroche
*Assistant Examiner*—Vincent De Luca
*Attorney, Agent, or Firm*—Robert J. Kraus

[57] ABSTRACT

The invention relates to a color display tube having a shadow mask (12) positioned in front of a display screen (8). The shadow mask (12) is coated at least on the side remote from the display screen with a heavy metal layer (14) of selectively varied thickness. The heavy metal has an atomic number exceeding 70 and has a high electron reflection coefficient, thus minimizing energy absorbed by the shadow mask from electrons impinging on the mask. Because of the selectively-varied thickness of the layer, reflection of electrons intercepted by the mask toward the screen is minimized without sacrificing the reduction in thermal expansion of the mask afforded by such a reflective layer.

7 Claims, 3 Drawing Figures

COLOR DISPLAY TUBE HAVING HEAVY METAL COATING ON COLOR SELECTION ELECTRODE

BACKGROUND OF THE INVENTION

The invention relates to a colour display tube comprising in an evacuated envelope means to generate a number of electron beams, a display screen having areas luminescing in different colours, and a colour selection electrode situated near the display screen and having apertures for passing through the electron beams and associating each electron beam with luminescent areas of a respective colour. The colour selection electrode is coated on at least the side remote from the display screen with the layer of a material comprising a heavy metal having an atomic number exceeding 70.

U.S. Pat. No. 3,562,518 discloses a colour display tube in which the colour selection electrode has a layer containing at least 20 mg of bismutch oxide per $cm^2$. The object of this layer is to reduce the quantity of X-ray radiation which is passed through the color selection electrode to the rear side of the tube after the radiation is generated by high-energy electrons impinging on the display screen.

During operation of a colour display tube having a colour selection electrode, usually called a shadow mask, only a small part of each electron beam is passed through the apertures of the shadow mask. Approximately 80 percent of the electrons are intercepted by the shadow mask on their way to the display screen. The kinetic energy of the electrons impinging on the shadow mask is converted for the greater part into thermal energy so that the temperature of the mask increases and hence the shadow mask experiences thermal expansion. Since the shadow mask is usually connected in a rigid supporting frame, the temperature of the shadow mask during warm-up will rise more rapidly in the centre than at the edge. The thermal expansion of the shadow mask associated with the rise in temperature results overall doming of the mesh in the direction towards the display screen. Furthermore, when a large quantity of electrons impinges on a location on the shadow mask, localized doming of the shadow mask will occur if temperature equilibrium in the plane of the shadow mask does not take place sufficiently rapidly. Both the local doming and the overall doming of the shadow mask results in a displacement of the spot formed on the display screen by the electrons passing through the mask apertures and colour defects occur in the picture displayed on the display screen.

In connection with this problem it is known from Japanese Patent Application No. 55.76553 to provide an electron-reflecting layer on the colour selection electrode, which layer also comprises a heavy metal, for example bismuth, lead or tungsten. The layer has a thickness of approximatley 10 microns and prevents the electrons incident on the colour selection electrode from penetrating into the colour selection electrode and converting their kinetic energy into thermal energy.

It has been found, however, that by using such a layer a number of detrimental side effects may occur. Notably, due to the large electron reflection power of the layer and the increased thickness of the colour selection electrode resulting from provision of the layer, an increased reflection of the electrons occurs at the walls of the apertures in the colour selection electrode. These reflected electrons impinge on the display screen in arbitrary places and deteriorate the picture quality.

Also, as the layer thickness increases, the possibility of the formation of loose particles in the tube also increases. These loose particles may, inter alia, lead to high voltage flash-overs in the electron gun and to black spots in the picture displayed on the screen. Furthermore, by providing thick layers the sizes of the apertures in the colour selection electrode transmission might be reduced, thereby decreasing through the colour selection electrode.

SUMMARY OF THE INVENTION

It is an object of the invention to provide a colour display tube in which the colour selection electrode has an electron-reflecting layer, but in which the above mentioned detrimental side effects are minimized.

According to the invention, a colour selection electrode is coated on at least the side remote from the display screen with a layer of a material comprising a heavy metal having an atomic number exceeding 70, and is characterized in that the part of the layer provided between the apertures of the colour selection electrode comprises approximately 0.2 to 2 $mg/cm^2$ of heavy metal and the part on the walls of the apertures comprises at most 0.2 $mg/cm^2$ of heavy metal.

The term "heavy metal" is to be understood to include here alloys of metals having atomic numbers higher than 70. The form in which the "heavy metal" is present in the layer plays no role for the invention. Therefore, compounds, alloys or mixtures of "heavy metals" also satisfy the object of the present invention.

Although, for example, gold and platinum are assumed to be materials suitable for the invention, according to a preferred embodiment of the invention the layer comprises heavy metal selected from the group consisting of tungsten, lead and bismuth for practical and economical considerations. According to a further embodiment of the invention the layer comprises heavy metal in the form of a compound selected from the group consisting of carbides, sulphides and oxides. According to a particular embodiment of the invention the layer consists at least substantially of a bismuth oxide and the layer comprises 0.2 to 0.8 mg of bismuth per $cm^2$.

In accordance with the invention the walls of the apertures in the colour selection electrode which are hit by the electron beams during operation, are covered by none or at most 0.2 $mg/cm^2$ of the heavy metal. This minimizes the electron reflections which deteriorate the quality of the displayed picture. In connection with this measure the choice of the method according to which the electron reflecting layer is provided on the colour selection electrode is of particular importance. A simple but suitable method is that in which grains of heavy metals or a heavy metal compound are sprayed onto the colour selection electrode as an aqueous suspension of low viscosity. During spraying, the air is sucked away on the side of the colour selection electrode which is not sprayed. The grains preferably have a size smaller than 1 micron. In this anner little or no heavy metal is deposited on the walls of the apertures in the colour selection electrode.

Another method of keeping the walls of the apertures in the colour selection electrodes free from heavy metal is that in which the walls, prior to providing the layer of heavy metal, are covered with a layer of photolacquer which is removed afterwards. This method is more laborious than the first method and due to the costs involved is not to be preferred.

In addition to a large electron reflection coefficient, layers of carbides, sulphides and oxides generally also have a large coefficient of thermal emission. A heavy metal layer can be provided on the shadow mask and then converted into a compound by firing in air thus increasing the coefficient of thermal emission by converting the layer into a so-called thermally black layer. Coefficient of thermal emission is to be understood to mean herein the ratio of the quantity of radiation given off to that given of by an ideal black body at the same temperature and in the same circumstances. According to a further embodiment of the invention the coefficient of thermal emission of the layer is at least 0.8 in the infra-red wavelength range $3<\lambda<40$ μm which is of interest for the present case.

BRIEF DESCRIPTION OF THE DRAWING

Embodiments of the invention will now be described in greater detail, by way of example, with reference to the drawing, in which.

DESCRIPTION OF THE PREFERRED EMBODIMENTS

Figure 1:
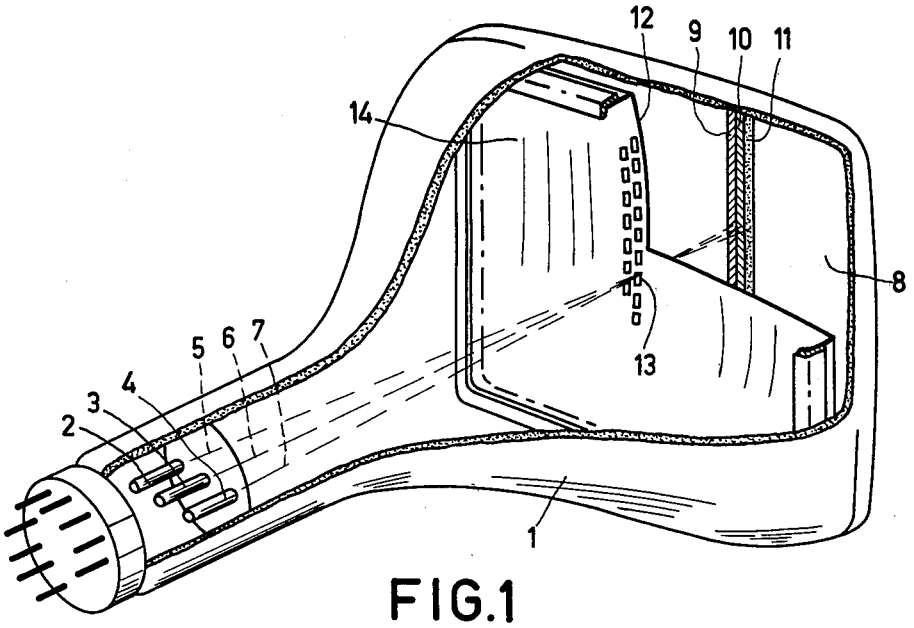
FIG. 1 shows diagrammatically a colour display tube according to the invention.
Figure 2:
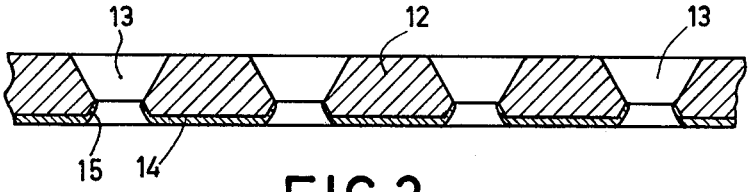
FIG. 2 is a sectional view of a part of the shadow mask of the tube shown in FIG. 1.

The colour display tube shown diagrammatically in FIG. 1 comprises a glass envelope 1 in which three (diagrammatically shown) electron guns 2, 3 and 4 are provide to generate three electron beams 5, 6, and 7. A display screen 8 is built up from a recurring pattern of phosphor strips 9, 10 and 11 luminescing in blue, green and red and which are associated with each of the electron beams 5, 6 and 7 in such manner that each electron beam impinges only on phosphor stripes of one colour. This is accomplished in known manner by means of a shadow mask 12 which is placed at a short distance before the display screen 8 and has rows of apertures 13 which pass a part of the electron beams 5, 6 and 7. Only approximately 20% of the electrons in the beams pass through the apertures 13 to the display screen 8. The remaining electrons are intercepted by the shadow mask 12, in which their kinetic energy is converted into thermal energy. In normal operating conditions of a colour display tube the temperature of the shadow mask 12 increases to approximately 75° to 80° C. As shown in FIG. 2, the side of the shadow mask facing the electron guns 2, 3 and 4 is covered with a bismuth oxide layer 14 comprising approximately 1 mg of bismuth per $cm^2$. The layer is built up from bismuth oxide grains having a grain size smaller than 1 micron and has been sprayed on the shadow mask in the form of an aqueous suspension, having a viscosity smaller than 2 mg Pa.S.

During spraying an air flow is maintained through the mask apertures 13 by means of a suction device, on the side of the mask 12 not sprayed. Because of this air flow little or no bismuth oxide lands on the wall 15 of the apertures 13 so that no undesired electron reflection (taper reflection) takes place at the walls 15 during operation of the tube.

The electron reflection coefficient of the layer 14 is approximately 0.5, so that approximately half of the incident electrons are reflected. This results not only in a lower temperature of the shadow mask but also reduces overall and localized doming of the shadow mask and the consequent displacement of the spot formed on the display screen by an electron beam. In comparison with a shadow mask not provided with the bismuth oxide layer, the displacement of the spot caused by the reduced doming is at least 25% smaller.

Figure 3:
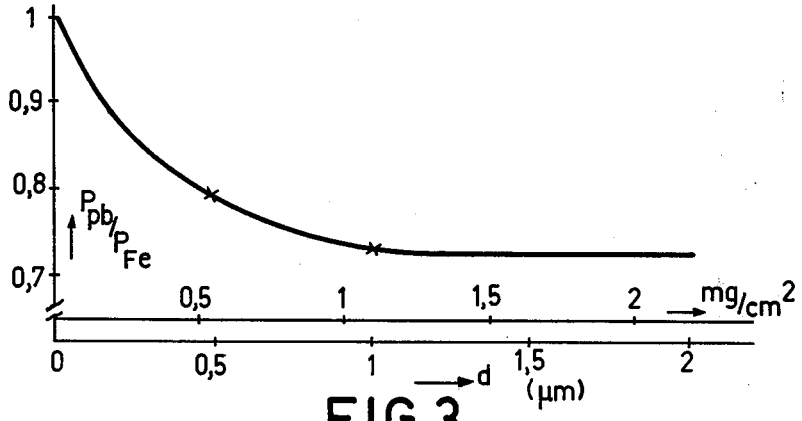
FIG. 3 shows the ratio of the electron energy absorption of a colour selection electrode (shadow mask) with and without heavy metal layer as a function of the layer thickness.

FIG. 3 shows the ratio $^{P}Pb/P_{Fe}$ of the electron energy absorption of an iron shadow mask with and without a layer of lead provided thereon as a function of the quantity of lead per $cm^2$. $P_{Pb}$ is the energy which is absorbed by the shadow mask when this is provided with a layer of lead, while $P_{Fe}$ is the energy absorbed by the mask in the absence of such a layer of lead. The graph shows clearly that the electron energy absorbed by the shadow mask decreases rapidly with an increasing quantity of lead and that layers with more than approximately 1 mg of lead per $cm^2$ provide little or no extra contribution to a smaller energy absorption. However, the above-mentioned side effects are restricted to an acceptable level when the content of lead between the mask apertures is not more than approximately 2 mg per $cm^2$ and on the walls of the mask apertures is not more than 0.2 mg/$cm^2$. The ratio $^{P}Pb/P_{Fe}$ as a function of the layer thickness in microns can also be read from FIG. 3 by means of the second horizontal axis shown.

Although FIG. 3 shows the results for a shadow mask covered with a layer of lead, the results obtained with other heavy metals, for example tungsten and bismuth, insubstantially from those obtained for a layer of lead.

A few examples of materials which satisfy the object of the present invention are given below in table form. Column A in the table lists metallic elements and compounds of metals provided on a blackeded iron shadow mask. The layer formed with the each material mentioned in column A comprises approximately 1 mg/$cm^2$ of the material. The shadow masks covered with these materials are fired in air for approximately one hour at a temperature of approximately 440° C. This is done because during the connection of the window the funnel portion of the tube envelope by means of a sealing glass, the shadow mask must endure such prolonged high temperatures. The fired layers have the electron reflection coefficients $\eta$ given in column B and the coefficient of thermal emission $\epsilon$ given in column C. Column D gives the percentage decrease in spot movement because of localized doming of the shadow mask as compared with that of a normal iron mask, that is one not treated according to the invention. For comparison the surface of normal iron a shadow mask not treated according to the invention has an electron reflection coefficient $\eta$ of approximately 0.2 and a coefficient of thermal emission $\epsilon$ of approximately 0.7.

| A provided material | B electron reflection coefficient $\eta$ | C coefficient of thermal emission $\epsilon$ | D reduced target movement |
|---|---|---|---|
| Pb | 0.50 | 0.80 | 20% |
| Bi | 0.50 | 0.85 | 25% |
| PbO | 0.47 | 0.85 | 25% |
| $Bi_2O_3$ | 0.48 | 0.87 | 25% |
| PbS | 0.45 | 0.95 | 30% |
| WC | 0.45 | 0.90 | 15% |
| $PbWO_4$ | 0.43 | <0.8 | 15% |

What is claimed is:

1. A color display tube comprising an envelope containing means for producing a number of electron beams, a display screen having areas for luminescing in a corresponding number of associated colors, and a color selection electrode disposed adjacent the display screen and having a plurality of apertures situated to effect passage of only the portions of each beam which will impinge on the screen areas of the associated color, said color selection electrode being covered on the side remotte from the display screen with a layer of material including a heavy metal having an atomic number exceeding 70, characterized in that the thickness of the material covering the color selection electrode surface extending between the apertures corresponds to a weight of approximately 0.2 to 2 mg/cm$^2$ and the thickness of the material covering walls defining said apertures corresponds to a weight which does not exceed 0.2 mg/cm$^2$.

2. A colour display tube as in claim 1, characterized in that the layer comprises heavy metal selected from the group consisting of tungsten, lead and bismuth.

3. A colour display tube as in claim 1 or 2, characterized in that the layer comprises heavy metal in the form of a compound selected from the group consisting of carbides, sulphides and oxides.

4. A colour display tube as in claim 3, characterized in that the layer consists essentially of a bismuth oxide material continuing 0.2 to 0.8 mg of bismuth per cm$^2$.

5. A colour display tube as in claim 1 or 2, characterized in that the coefficient of thermal emission of the layer is at least 0.8.

6. A color display tube comprising an envelope containing means for producing a number of electron beams, a display screen having areas for luminescing in a correspnding number of associated colors, and a color selection electrode disposed adjacent the display screen and having a plurality of apertures situated to effect passage of only the portions of each beam which will impinge on the screen areas of the associated color, said color selection electrode being covered on the side remote from the display screen with a layer of material including a heavy metal having an atomic number exceeding 70, characterized in that said layer is a spray coating which has been applied to said side while suction is applied to the opposite side of the color selection electrode, the thickness of the material covering the color selection electrode surface extending between the apertures corresponding to a weight of approximately 0.2 to 2 mg/cm$^2$, and the thickness of the material covering walls defining said apertures corresponding to a weight which does not exceed 0.2 mg/cm$^2$.

7. A method for manufacturing an apertured color selection electrode to be positioned in a color display tube with one side adjacent a display screen having areas which luminesce in different colors when struck by respective electron beams directed at the remote side of the electode and passing through said apertures, characterized in that an electron reflective layer is applied to the remote side of the color selection electrode by spraying said side with a solution including a heavy metal having an atomic number exceeding 70 while applying suction to the opposite side of the electrode, effecting covering of the color selection electrode surface extending between the apertures with a thickness of the material corresponding to a weight of approximately 0.2 to 2 mg/cm$^2$, and effecting covering of walls defining said apertures with a thickness of the material corresponding to a weight which does not exceed 0.2 mg/cm$^2$.

* * * * *